US006158359A

United States Patent [19]

Allan et al.

[11] Patent Number: 6,158,359

[45] Date of Patent: Dec. 12, 2000

[54] ADJUSTABLE COMPUTER KEYBOARD SUPPORT MECHANISM

[75] Inventors: Scott Allan, Kitchener; Michael Woof, Guelph, both of Canada

[73] Assignee: Waterloo Furniture Components, Ltd., Ontario, Canada

[21] Appl. No.: 09/264,787

[22] Filed: Mar. 9, 1999

Related U.S. Application Data

[60] Continuation-in-part of application No. 08/967,546, Nov. 10, 1997, Pat. No. 5,878,674, which is a division of application No. 08/478,868, Jun. 7, 1995, Pat. No. 5,685,235, which is a division of application No. 08/092,772, Jul. 16, 1993, Pat. No. 5,513,579.

[51] Int. Cl.[7] ..... A47B 57/00

[52] U.S. Cl. ..... 108/93; 108/1; 248/918

[58] Field of Search ..... 108/93, 1, 6, 8, 108/10, 50.01; 248/918, 919, 242

[56] References Cited

U.S. PATENT DOCUMENTS

| | | | |
|---|---|---|---|
| 1,565,246 | 12/1925 | Axen | 108/93 X |
| 4,625,657 | 12/1986 | Little et al. | 108/93 |
| 4,632,349 | 12/1986 | Anstey . | |
| 4,644,875 | 2/1987 | Watt | 108/93 |
| 4,706,919 | 11/1987 | Soberalski et al. . | |
| 4,776,284 | 10/1988 | McIntosh . | |
| 4,779,922 | 10/1988 | Cooper . | |
| 4,826,123 | 5/1989 | Hannah et al. . | |
| 4,843,978 | 7/1989 | Schmidt et al. . | |
| 5,037,054 | 8/1991 | McConnell . | |
| 5,041,770 | 8/1991 | Seiler et al. . | |
| 5,211,367 | 5/1993 | Musculus . | |
| 5,513,579 | 5/1996 | Allan | 108/93 |
| 5,685,235 | 11/1997 | Allan | 108/93 |
| 5,697,303 | 12/1997 | Allan | 108/93 |
| 5,823,487 | 10/1998 | Kirchhoff et al. | 108/93 X |
| 5,878,674 | 3/1999 | Allan | 108/93 |

*Primary Examiner*—Jose V. Chen
*Attorney, Agent, or Firm*—Banner & Witcoff, Ltd.

[57] ABSTRACT

The present computer keyboard support assembly comprises a platform suitable for supporting a keyboard mechanism having one end of an arm pivotally mounted to the platform and the other end pivotally mounted to a mounting bracket which is attached to the underside of a work surface. A compensating mechanism utilizing a driving mechanism interacting with the pivot mountings for the arm and controlling the orientation of the platform, as the platform is moved to and from a storage and use position.

15 Claims, 8 Drawing Sheets

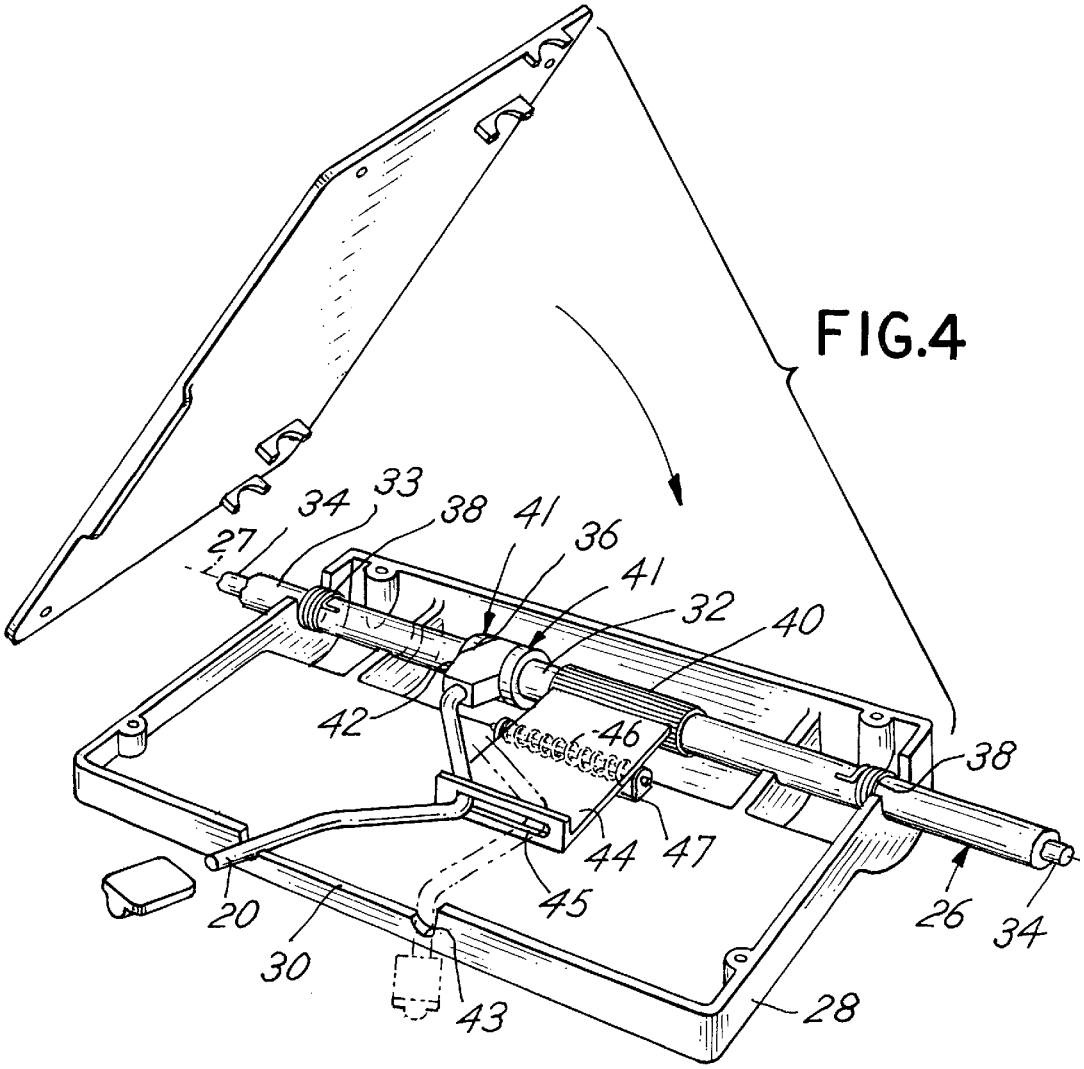
FIG.5
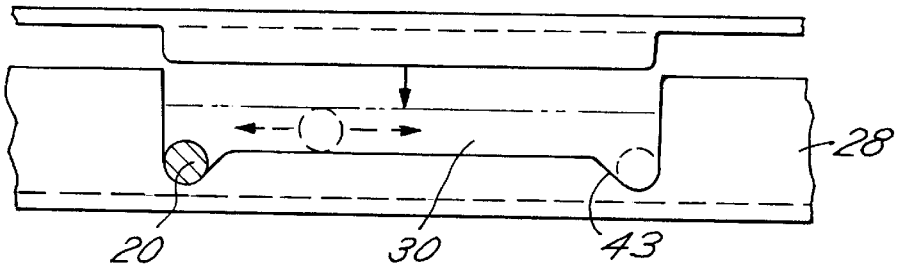

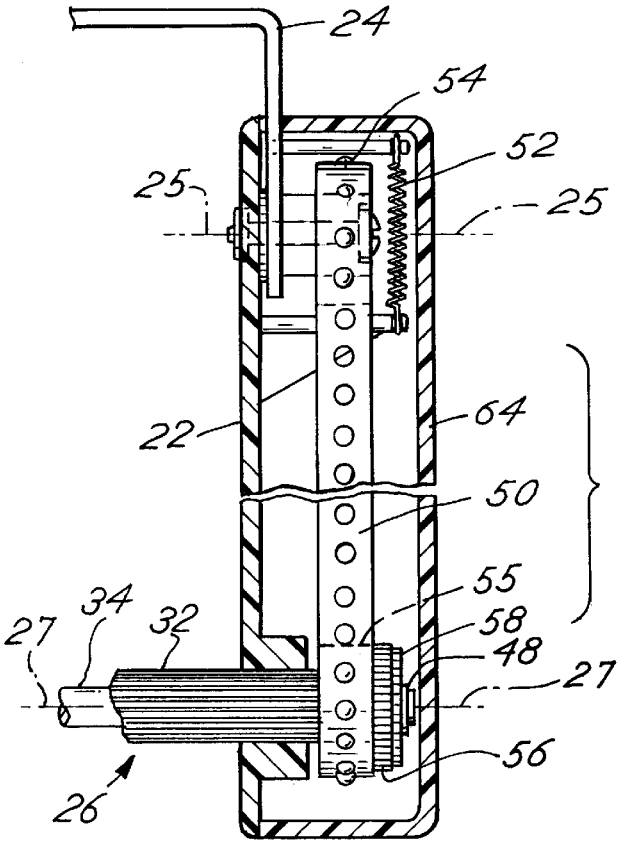
FIG.6
FIG.7
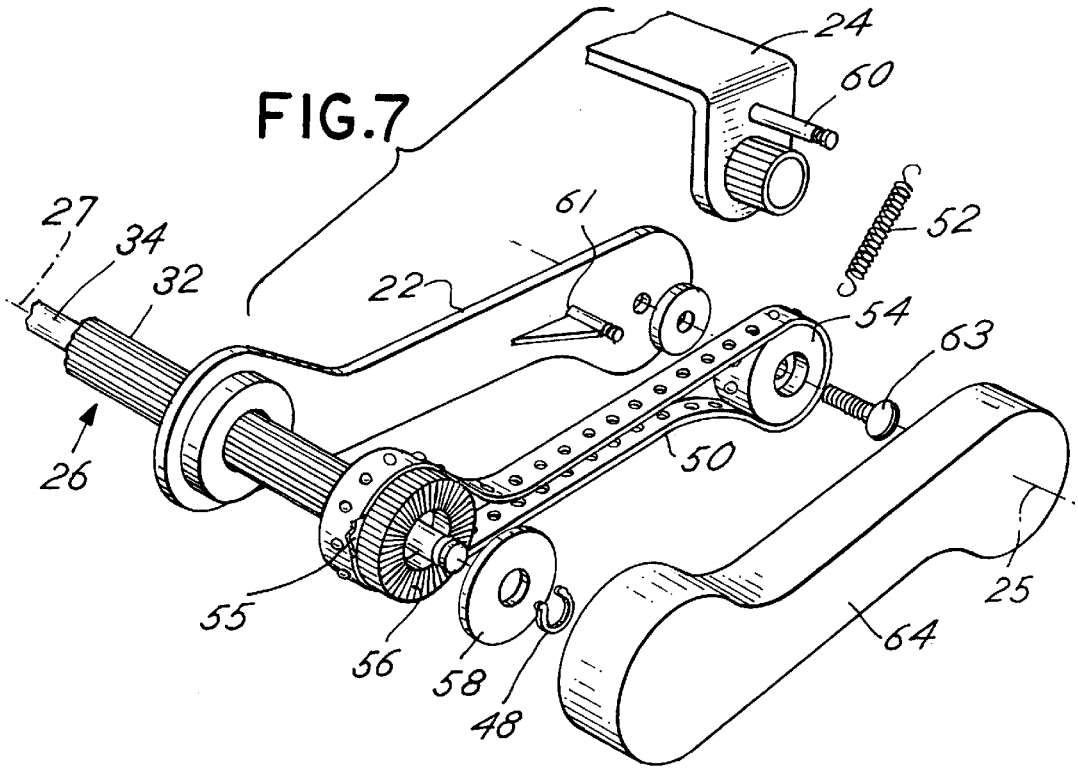

FIG.8
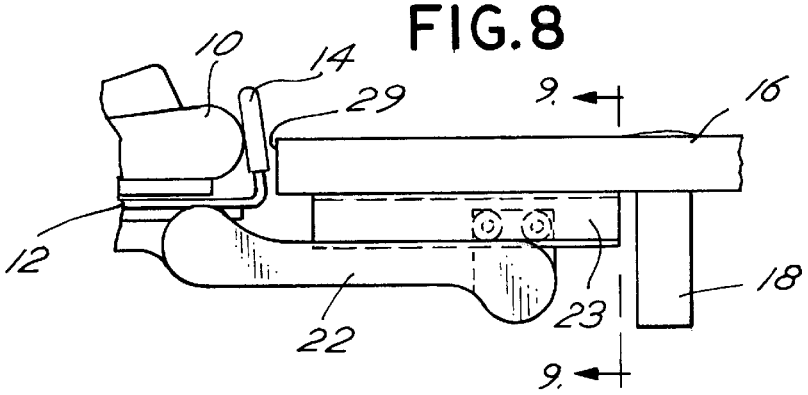
FIG.9
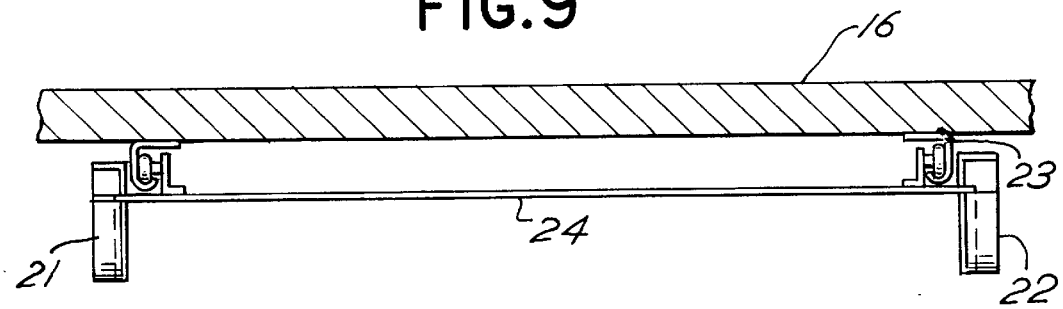
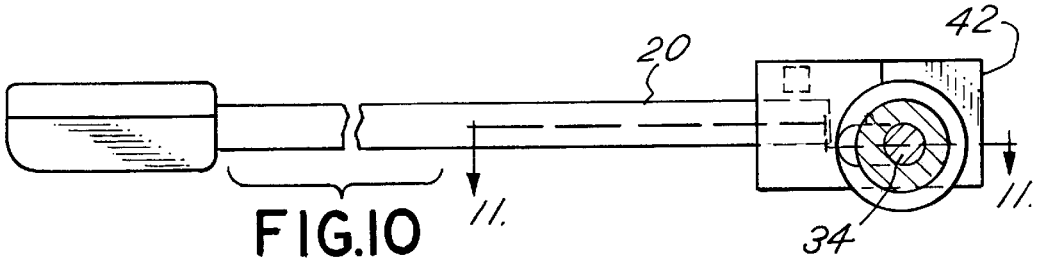
FIG.10
FIG.11
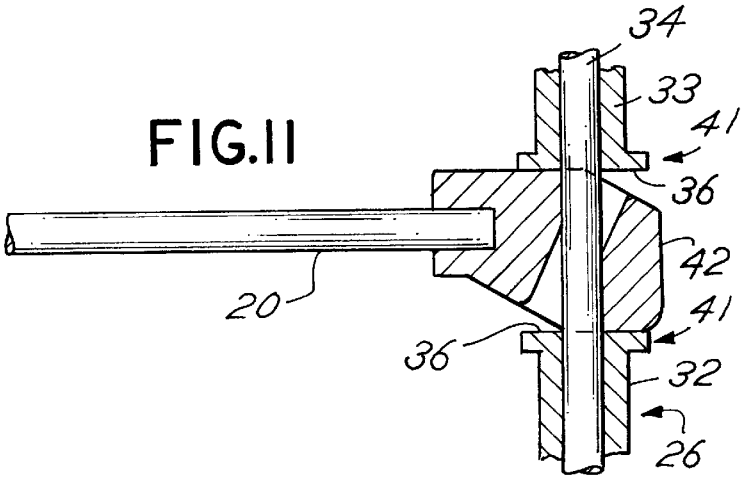

ADJUSTABLE COMPUTER KEYBOARD SUPPORT MECHANISM

CROSS REFERENCE TO RELATED APPLICATIONS

This is a continuation in part of application Ser. No. 08/967,546 filed Nov. 10, 1997, now U.S. Pat. No. 5,878,674, issued Mar. 9, 1999, which is a division of U.S. Ser. No. 08/478,868 filed Jun. 7, 1995 now U.S. Pat. No. 5,685,235, filed Jun. 7, 1995, which is a division of U.S. Ser. No. 08/092,772 filed Jul. 16, 1993 now U.S. Pat. No. 5,513,579, filed Jul. 16, 1993.

BACKGROUND OF THE INVENTION

This invention relates to an improved adjustable support mechanism for a computer keyboard or the like. Heretofore, there have been various mechanisms for supporting keyboards associated with computer terminals. One such device is disclosed in Smeenge, U.S. Pat. No. 4,616,798, entitled: ADJUSTABLE SUPPORT FOR CRT KEYBOARD, wherein the keyboard support mechanism comprises first and second sets of parallel, equal length articulating arms which link first and second brackets associated respectively with a keyboard platform and a sliding plate attached beneath a desk top. The parallel arms move in a generally vertical plane and maintain the keyboard support platform in a generally horizontal position regardless of the position of the platform relative to the desk top. These arms are connected to brackets located in the central portion of the platform remote from the edges of the keyboard support platform. During storage of the keyboard support platform, the arms articulate and the platform is thereby lowered to a retracted position beneath the level of the desk top. During use, the platform is pivoted forward to an extended position. the brackets supporting the inside ends of the arms beneath the desk may be slidably attached to a support plate attached to the bottom side of the desk. In this manner, the assembly may slide beneath the desk for storage.

Other keyboard supports are illustrated in U.S. Pat. No. 4,625,657; U.S. Pat. No. 4,632,349; U.S. Pat. No. 4,706,919; U.S. Pat. No. 4,776,284; U.S. Pat. No. 4,826,123; and U.S. Pat. No. 4,843,978. Each of these patents describes a support mechanism designed for carrying a computer keyboard or the like. Each employs a parallel arm type mechanism that allows adjustment of the keyboard support.

Another keyboard support mechanism is disclosed in McConnell, U.S. Pat. No. 5,037,054, entitled: ADJUSTABLE SUPPORT MECHANISM FOR A KEYBOARD PLATFORM. U.S. Pat. No. 5,037,054 teaches a keyboard support mechanism that employs nonparallel arms to support the keyboard platform. This mechanism does not maintain the keyboard platform in a horizontal position as the arms articulate. This mechanism thus has the benefit that when the keyboard platform is stored under the table, the platform is reoriented to supply greater access to the kneehole of a desk.

The prior art mechanisms have proven to be useful in conjunction with standard desk equipment. However, many desks contain lateral supports which interfere with the operation and/or storage of the prior art keyboard support mechanisms. Moreover, many of the prior art mechanisms tended to bounce when in use, resulting in an unstable work surface. Therefore, there developed the need for a computer keyboard support mechanism which provides the ability to adequately support a computer keyboard, to store the computer keyboard and to provide improved access to the kneehole opening in the desk to which the computer keyboard platform is attached. Further, there is a need for an improved computer keyboard support device which can provide unlimited positioning of the orientation of the keyboard platform and at the same time, provide a stable surface for the keyboard.

It should also be appreciated that there has recently been much attention paid to repetitive strain injury (RSI), including carpal tunnel syndrome. These injuries have been associated with extended typing on computer keyboards. It has been suggested that the ability to type with less bend in the wrist may reduce the risk of injury. Therefore, there remains a need for a keyboard support that is adjustable, to potentially reduce the risk of repetitive strain injury such as carpal tunnel syndrome.

SUMMARY OF THE INVENTION

In a principal aspect, the computer keyboard support assembly of the present invention comprises a platform suitable for supporting a keyboard mechanism having one end of an arm pivotally mounted to the platform and the other end pivotally mounted to a mounting bracket which is attached to the underside of a work surface. A compensating mechanism utilizes a driving mechanism interacting with the pivot mountings for the arm and controls the orientation of the platform as the platform is moved to and from a storage and use position. Various compensating mechanisms are taught.

As another aspect of the invention, there is provided a mechanism that allows the platform to be tilted and locked in a tilted position. This tilt can create either a positive or a negative slope with respect to the platform.

In a further aspect of the invention, there is provided a mechanism for locking a keyboard to the platform. This mechanism allows the keyboard to be securely attached to the platform as the support arms are moved from an extended position to a storage position.

In still another aspect of the invention, there is a slide mechanism associated with the mounting bracket that allows the entire support assembly to be moved inwardly or outwardly with respect to the front edge of the work surface.

In still a further aspect of the invention, the keyboard support assembly can be swung into a storage position substantially adjacent to the underside of the work surface. Thus, when the support arms of the mechanism are pivoted from the extended position to the storage position, the keyboard platform is stored beneath the work surface in a manner that does not limit the access to the kneehole opening of the desk.

Yet a further aspect of the invention utilizes a pair of support arms connecting the edges of the platform and a bracket attached to the underside of a desk.

In yet a further aspect, this invention provides a keyboard support mechanism that is adjustable to positions both above and below the level of the top of the desk to which it is mounted.

Thus, it is an object of the invention to provide an improved adjustable support assembly for a keyboard platform.

It is a further object of the invention to provide an improved platform support assembly that has a lateral support.

Another object of the invention is to provide a computer keyboard support assembly that maintains the orientation of the keyboard platform as the support arms positioned at either end of said platform are pivoted through an arc in a vertical plane.

Still another object of the invention is to provide a computer keyboard support assembly that can be stored easily under a work surface and still maintain access to the kneehole.

A further object of the invention is to provide a computer keyboard support assembly which allows for orientation of the computer keyboard to alleviate strain upon the operator and potentially reduce the incidence of repetitive strain injury.

Yet another object of the invention is to provide a computer keyboard support assembly of simplified and rugged construction easily manufactured to be both durable and useful.

These and other objects, advantages and features will be set forth in the detailed description which follows.

BRIEF DESCRIPTION OF THE DRAWINGS

In the detailed description which follows, reference will be made to the drawings comprised of the following figures:

FIG. 4 is a perspective view of the tilt adjustment mechanism;

FIG. 5 is a partial front cross-section of FIG. 4;

FIG. 6 is a cross-section of the compensating mechanism associated with the support rm;

FIG. 7 is an exploded drawing, illustrating the compensating mechanism;

FIG. 8 is a side elevation, illustrating an embodiment with a slide mechanism;

FIG. 9 is a cross-section of FIG. 8 along line IX—IX;

FIG. 10 is a side view of the cam locking mechanism;

FIG. 11 is a cross-section of FIG. 10 along line X—X;

DETAILED DESCRIPTION OF THE PREFERRED EMBODIMENT

Figure 1:
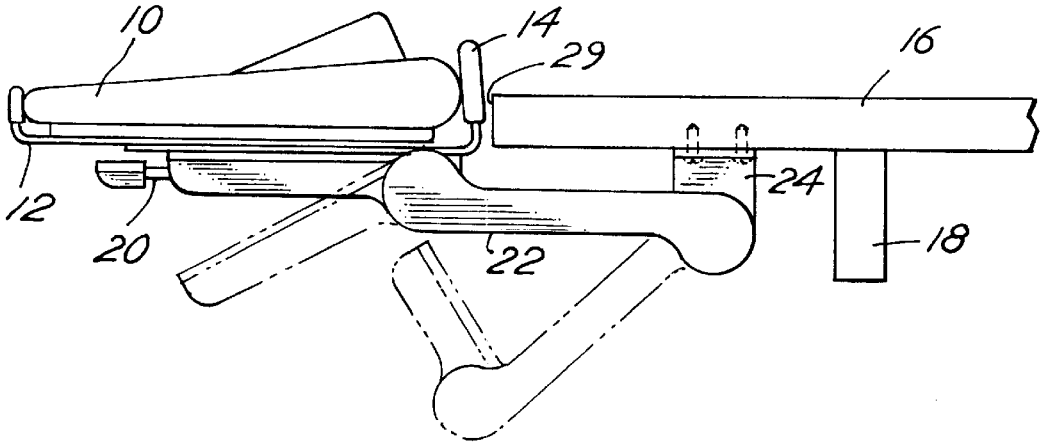
FIG. 1 is a side elevation of the preferred embodiment of the keyboard support assembly of the invention.
Figure 2:
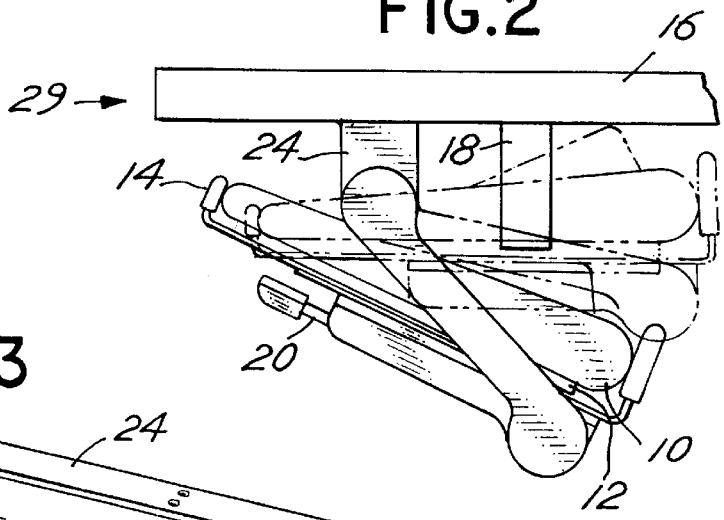
FIG. 2 is a side elevation of the preferred embodiment of the keyboard support assembly of the invention attached to the underside of a work surface, illustrating the motion of the invention in phantom lines.
Figure 3:
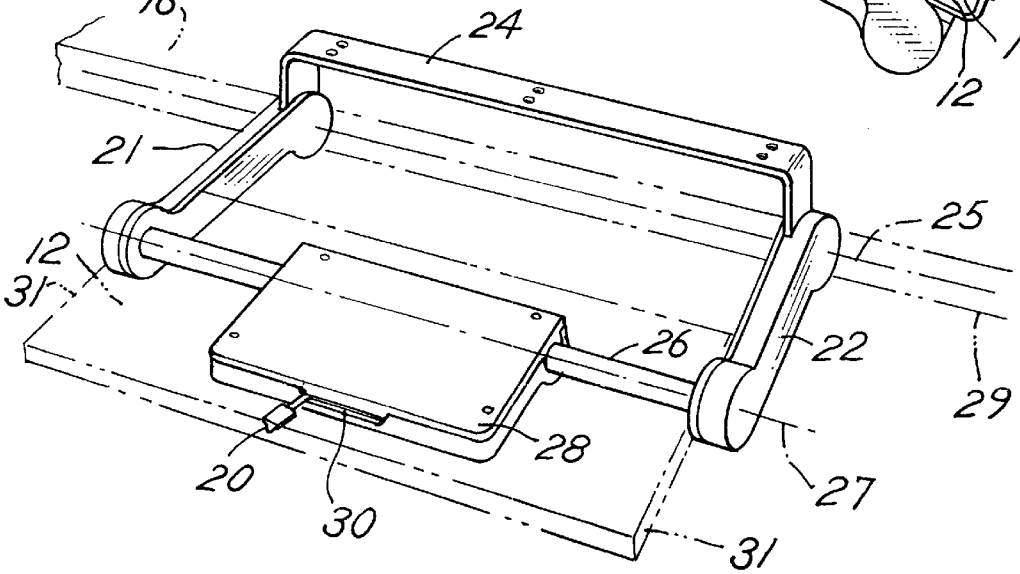
FIG. 3 is a perspective view of the support mechanism of the invention, illustrating the location of the tilt adjustment mechanism and showing the platform and desk in phantom lines.

Before describing the component parts of the invention, a brief description of the manner in which the assembly operates will be beneficial in illustrating the construction of the assembly. Reference is thus directed to FIGS. 1, 2 and 3. As shown in FIGS. 1 and 2, a keyboard 10 is mounted on a keyboard platform 12. The keyboard platform 12 is supported by a pair of spaced support arms 21, 22. The first ends of support arms 21, 22 are pivotally mounted to opposite sides of the keyboard platform 12 and the second ends of the support arms 21, 22 are pivotally mounted to a mounting bracket 24. The mounting bracket 24 is associated with or attached to the underside of a work surface 16. As illustrated in FIG. 3, the support arms 21, 22 pivot about a first horizontal pivot axis 25 passing through the mounting bracket 24. As the support arms 21, 22 pivot about the first horizontal pivot axis 25, the computer keyboard 10 and the platform 12 are moved from a work position to a storage position under the work surface 16. As the support arms 21, 22 pivot about the first horizontal pivot axis 25, the keyboard platform 12 pivots about a second horizontal pivot axis 27 with respect to the support arms 21, 22 thereby maintaining the keyboard platform 12 in the same orientation with respect to the work surface 16, the second horizontal pivot axis 27 being substantially parallel to the first horizontal pivot axis 25.

The orientation of the keyboard platform 12 is generally horizontal. However, the keyboard platform 12 is also adjustable and can be tilted about a horizontal axis. In a preferred embodiment, this horizontal axis corresponds with the second horizontal pivot axis 27. This tilt allows the angle of the keyboard platform 12 and the associated keyboard 10 to be altered to the preferred position of the user. FIG. 1 illustrates in phantom lines how the keyboard platform 12 can be tilted with either a positive or a negative tilt. This tilt feature, in combination with the pivoting motion of the support arms 21,22 allows the keyboard 10 to be efficiently stored under the work surface 16, even if the work surface 16 has an obstruction such as a lateral support 18.

Another preferred embodiment of the invention (shown in FIGS. 8 and 9) includes a sliding mechanism 23 which allows the mounting bracket 24 to be moved in a direction perpendicular to the front edge 29 of the work surface 16. Such a slide mechanism 23 permits further adjustment for the computer platform 12 and the associated keyboard 10. The bracket 24 and slide mechanism 23 may also be associated with a vertical axis, pivot mechanism (not shown) allowing the entire assembly to pivot about the vertical axis.

FIG. 3 illustrates the basic components of a preferred embodiment of the present invention. The keyboard platform 12 (shown in phantom) is mounted upon a casing 28. Any appropriate means for mounting is acceptable. In the preferred embodiment screws or bolts are used depending on the material used for the keyboard platform 12. A pivot shaft or rod 26 passes through the casing 28 in a manner that permits rotation of the casing 28 about the shaft 26. The shaft 26 is pivotally associated at its ends with the first ends of the support arms 21, 22. The second ends of the support arms 21, 22 are, in turn, pivotally associated with a mounting member which is shown in FIG. 3 as the mounting bracket 24. The mounting bracket 24 is mounted on the underside of the work surface 16. As stated above, the mounting member may also include a slide mechanism 23 which allows the bracket 24 to move in a direction perpendicular to the front edge of the work surface 16.

The preferred embodiment of FIG. 3 illustrates two support arms 21, 22 spaced apart about the same distance as the width of the keyboard platform 12. The width of the keyboard platform 12 is defined by its two opposite sides 31. It should be appreciated that the support arms 21, 22 can be located intermediate the opposite sides 31 of the keyboard platform 12. Indeed, the present invention includes an embodiment wherein only one support arm 22 is utilized, said support arm 22 being associated with the central portion of the keyboard platform 12. Such a single support arm assembly is, however, less preferred as it does not provide the stability of an assembly with two spaced apart support arms 21, 22.

FIG. 3 further illustrates a locking lever 20 which actuates a locking mechanism within casing 28. As more fully described below, this locking mechanism preferably fixes the angle of tilt about the second horizontal pivot axis 27 and controls the rotation of platform 12 about the first horizontal pivot axis 25.

FIGS. 6 and 7 illustrate the relationship of the support arm 22 with both the mounting bracket 24 and the pivot shaft 26. As shown, the support arm 22 is pivotally mounted on the inside surface of the mounting bracket 24. Any appropriate pivotal mount will suffice. In the preferred embodiment, the pivotal mount is a bolt 63 positioned along the first horizontal pivot axis 25 associated with both the mounting bracket 24 and the support arm 22. The mounting bracket 24 is supplied with a first spring post 60 which extends from the bracket 24 and is adapted to receive one end of a tension spring 52. The support arm 22 likewise includes a second spring post 61 which extends in a direction substantially the same as the first spring post 60 and is adapted to receive the opposing end of tension spring 52. Tension spring 52 acts to counterbalance the weight of the support arms 21, 22 and the computer keyboard platform 12, thereby keeping the platform 12 and the support arms 21, 22 in a home position. This home position may be substantially horizontal or it may be set at any other desirable angle by altering the size and tension of the spring 52.

FIGS. 6 and 7 further illustrate a compensating mechanism that maintains the orientation of the keyboard platform 12 while the support arms 21, 22 are pivoted about the first horizontal pivot axis 25. Referring specifically to FIG. 7, the compensating mechanism of the preferred embodiment comprises a fixed sprocket 54, a rotating sprocket 55, and an endless compensating belt 50 keyed to the sprockets 55, 54. The fixed sprocket 54 is non-rotatably attached to the mounting bracket 24. The non-rotatably attachment may be done by a spline or any other appropriate attaching means. The compensating belt 50 is associated with the non-rotating sprocket 54. In the preferred embodiment, the belt 50 consists of a perforated tape where the perforations are associated with the teeth of the fixed sprocket 54. An appropriate perforated tape is commercially available under the trade name Dymetrol. The compensating belt 50 is also associated with the rotating sprocket 55. In a similar manner, in a preferred embodiment, the perforations of the belt 50 are associated with the teeth of the rotating sprocket 55.

The rotating sprocket 55 is mounted upon the pivoting shaft 26 in a manner such that when the shaft 26 pivots, the rotating sprocket 55 also pivots. An example of such a mounting is shown in FIGS. 6 and 7. The pivot shaft 26 is comprised of three components, an inner shaft 34, a right outer shaft 32, and a left outer shaft 33 (shown in FIG. 4). The rotating sprocket 55 is mounted on one of the outer pivot shafts 32, 33 and secured by washer 58 and clip 48. Thus, when the support arms 21, 22 are rotated about the first horizontal pivot axis 25, the compensating belt 50 will be wrapped around the fixed sprocket 54 which, in turn, will cause rotation of the rotating sprocket 55 and his, in turn, would cause a corresponding rotation of the outer pivot shaft 32, 33. Because the orientation of the keyboard platform 12 is related to the position of the outer shaft 32, 33 as the pivot shaft 26 rotates, so will the keyboard platform 12. This rotation keeps the orientation of the keyboard platform 12 unchanged.

The compensation mechanism is preferably further supplied with clutch plate 56 to avoid slippage and/or movement of the rotating sprocket 55 due to external pressures. The clutch plate 56 is affixed to the outside of rotating sprocket 55. In a preferred embodiment, the clutch plate 56 is an integral part of the rotating sprocket 55. The clutch plate 56 is designed to engage the washer 58 and thereby keep the rotating sprocket 55 from rotating and resulting in the position of the keyboard platform 12 being fixed.

It is desirable that the compensating belt 50 of the compensating mechanism be taut at all times. To facilitate this the compensating mechanism may include an idler assembly. An example of an idler assembly may include an idler wheel which rides on compensating belt 50. The idler wheel is spring biased to apply pressure to the compensating belt 50. In this manner, the compensating belt 50 is kept taut during operation even though it may stretch during use. Other types of idler systems could also be used, including a set screw capable of tightening the belt.

In a particularly preferred embodiment of the invention, there is a separate compensating mechanism associated with each of the support arms 21, 22. Such a design reduces the stress on the components of the compensating mechanism. Each compensating mechanism would be enclosed in an arm housing 64 to isolate the sprockets 54, 55 and the compensating belt 50 from the operator.

The compensating mechanism of the present invention can have alternative constructions. For example, the sprockets 54, 55 and belt 50 may be replaced with a gear and chain assembly or a gear and belt assembly wherein the belt is adapted to associate with the cogs of the gear. As a further example, the compensating mechanism could incorporate a planetary gear system in which one planet gear or a series of planet gears rotates about another fixed sun gear(s). In each such assembly, the appropriate compensating movement can be accomplished.

Figure 12:
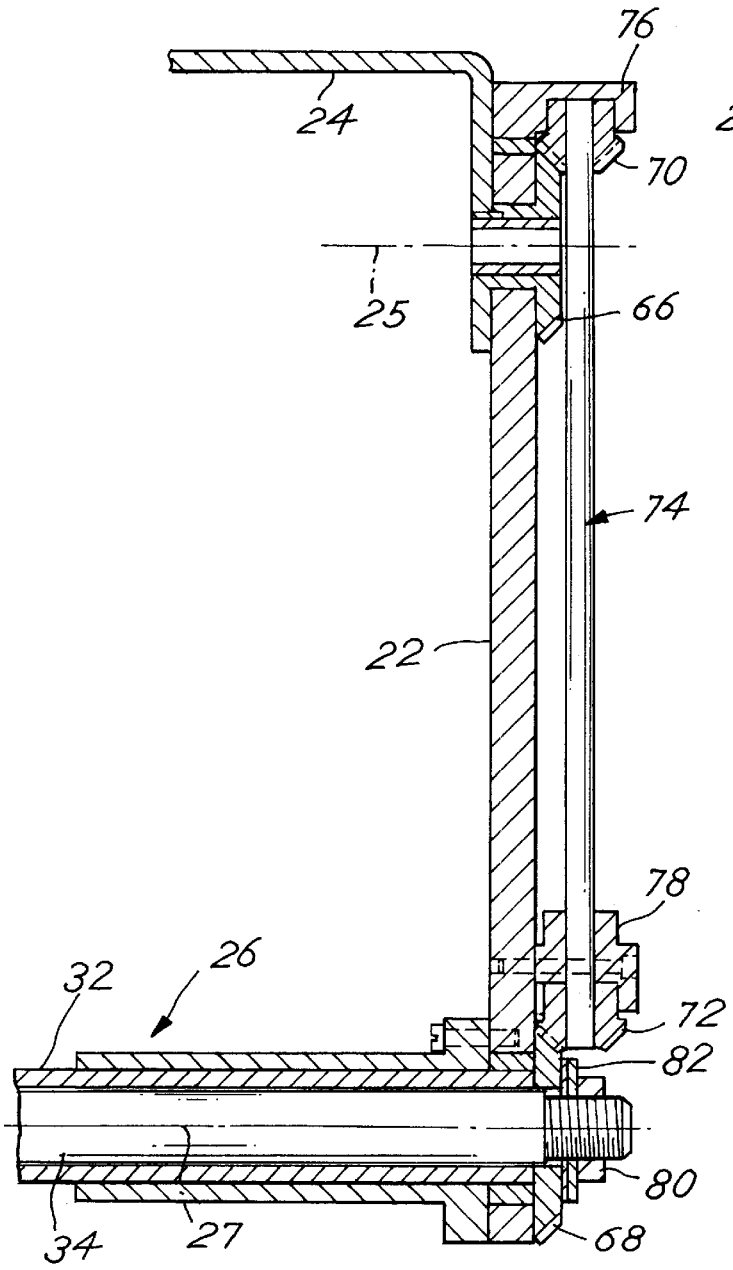
FIG. 12 is a cross-section of an alternative compensating mechanism associated with the support arm.
Figure 13:
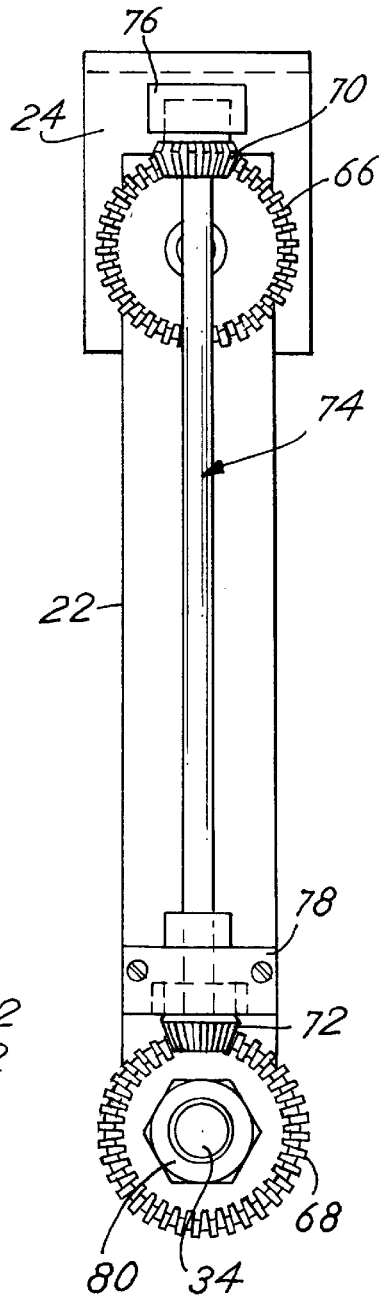
FIG. 13 is a cross-section of FIG. 12 along line XII—XII.

Another alternative embodiment of the compensating means is shown in FIGS. 12 and 13. In this alternative embodiment, a fixed beveled gear 66 is non-rotatably mounted on the mounting bracket 24. The fixed beveled gear 66 is associated with a first pinion gear 70. The first pinion gear 70 is positioned at and engages one end of a pinion shaft 74. The opposing end of pinion shaft 74 engages a second pinion gear 72. The second pinion gear 72 is associated with a rotating beveled gear 68. The opposing ends of the pinion shaft 74 are associated with a first pinion shaft bearing 76 and a second pinion bearing 78, respectively. These pinion shaft bearings 76, 78 allow for rotation of the pinion shaft 74 while pinion gears 70, 72 are in operative engagement with the respective bevel gears 66, 68. In addition, the pinion shaft bearings 76, 78 are affixed to the keyboard tray support arm 22.

In operation, the keyboard tray support arm 22 is pivoted about the first substantially horizontal axis 25. This pivot action causes the first pinion gear 70 to move around fixed beveled gear 66. This motion results in the rotation of the pinion shaft 74 and a corresponding rotation of the second pinion gear 72. The rotation of the second pinion gear 72 drives the second beveled gear 68, which in turn, rotates the outer shaft 32. The rotation of the outer shaft 32 acts to keep the orientation of the keyboard platform 12 unchanged with respect to horizontal, as the support arm 22 is pivoted.

The lock mechanism within the casing 28 is illustrated in FIGS. 4 and 5. The lock mechanism is actuated by movement of locking lever 20 in a guideway 30. The lock mechanism performs two functions: first, it provides a means for locking the assembly in a selected vertical position; second, it provides a means for locking the keyboard platform 12 at a particular tilt angle. Preferably both of these locking functions are actuated by the single locking lever 20.

The assembly is locked in a selected vertical position by moving the locking lever 20 laterally from one extreme of guideway 30 to the other. The locking lever 20 has two settings: a locked position preventing the pivoting of the support arms 21, 22 about the first horizontal pivot axis 25; and free moving position allowing the support arms 21, 22 to pivot about the first horizontal pivot axis 25.

Locking at a particular vertical position is accomplished through the association of a locking cam 42 with pivot shaft 26. The interaction of the pivot shaft 26 and the locking cam 42 is shown in more detail in FIGS. 10 and 11. The inner shaft 34 spans the distance between the two support arms 21, 22 and passes through the locking cam 42. The inner shaft 34 provides support for both outer shafts 32,33. The two outer shafts 32, 33 are positioned concentrically around the inner shaft 34. Each outer shaft 32, 33 has a cam bearing end 41. This cam bearing end 41 defines a cam bearing surface 36. This cam bearing surface 36 may be created in any appropriate way such as a washer or an integral flange. The movement of the locking lever 20 in guideway 30 causes the locking cam 42 to engage or disengage the cam bearing surface 36 of the outer shafts 32, 33 and the surface of the inner shaft 34. When the locking cam 42 engages the respective cam bearing surfaces 36, the clutch plate 56 is forced into contact with washer 58 fixing rotating sprocket 55 in place. As a result, the support arms 21, 22 cannot pivot about the first horizontal pivot axis 25 and the vertical position of the keyboard platform 12 is locked. Conversely, when the locking cam 42 disengages the respective surfaces, the clutch plate 56 disengages the washer 58, the rotating sprocket 55 is free to rotate and thus the support arms 21, 22 are free to pivot and the vertical position of the keyboard platform 12 can be adjusted.

The tilt of the keyboard platform 12 is preferably also controlled by the locking lever 21, although a separate actuator may be employed. The locking lever 20 is associated with a locking plate 44. The locking plate 44 engages a clutch surface 40 of the pivot shaft 26. When locking plate 44 engages the clutch surface 40, it locks the tilt angle of the keyboard platform 12. The locking plate 44 is disengaged from the clutch surface 40 when the locking lever 20 is lifted out of a notched portion 43 of the guideway 30. More specifically, in a preferred embodiment, the locking lever 20 passes through a slot 45 in the locking plate 44. The locking plate 44 is biased by spring 46 to engage the clutch surface 40. As the locking lever 20 is lifted out of the notch portion 43 of the guideway 30, it lifts the locking plate 44 by engaging the upper surface of the slot 45. This lifting causes the locking plate 44 to pivot about a fulcrum 47, counteracting the biasing force of spring 46 and resulting in disengagement of the clutch surface 40. With this disengagement, the casing 28 is free to pivot about the second horizontal pivot axis 27 a defined by the pivot shaft 26.

The tilt mechanism is also supplied with torsion springs 38 which interact with the casing 28 around the pivot shaft 26 such that the keyboard platform 12 has a tilt home position. This tilt home position may be horizontal or may be adjusted to any desired angle. More specifically, when the keyboard platform 12 is tilted, the torque upon the springs 38 is increased and that torque is maintained by locking the locking plate 44 against the clutch surface 40, thereby maintaining the computer keyboard platform 12 at the appropriate tilt. When the locking plate 44 is released from the clutch surface 40, the springs 38 will bring the keyboard platform 12 to the tilt home position.

Figure 14:
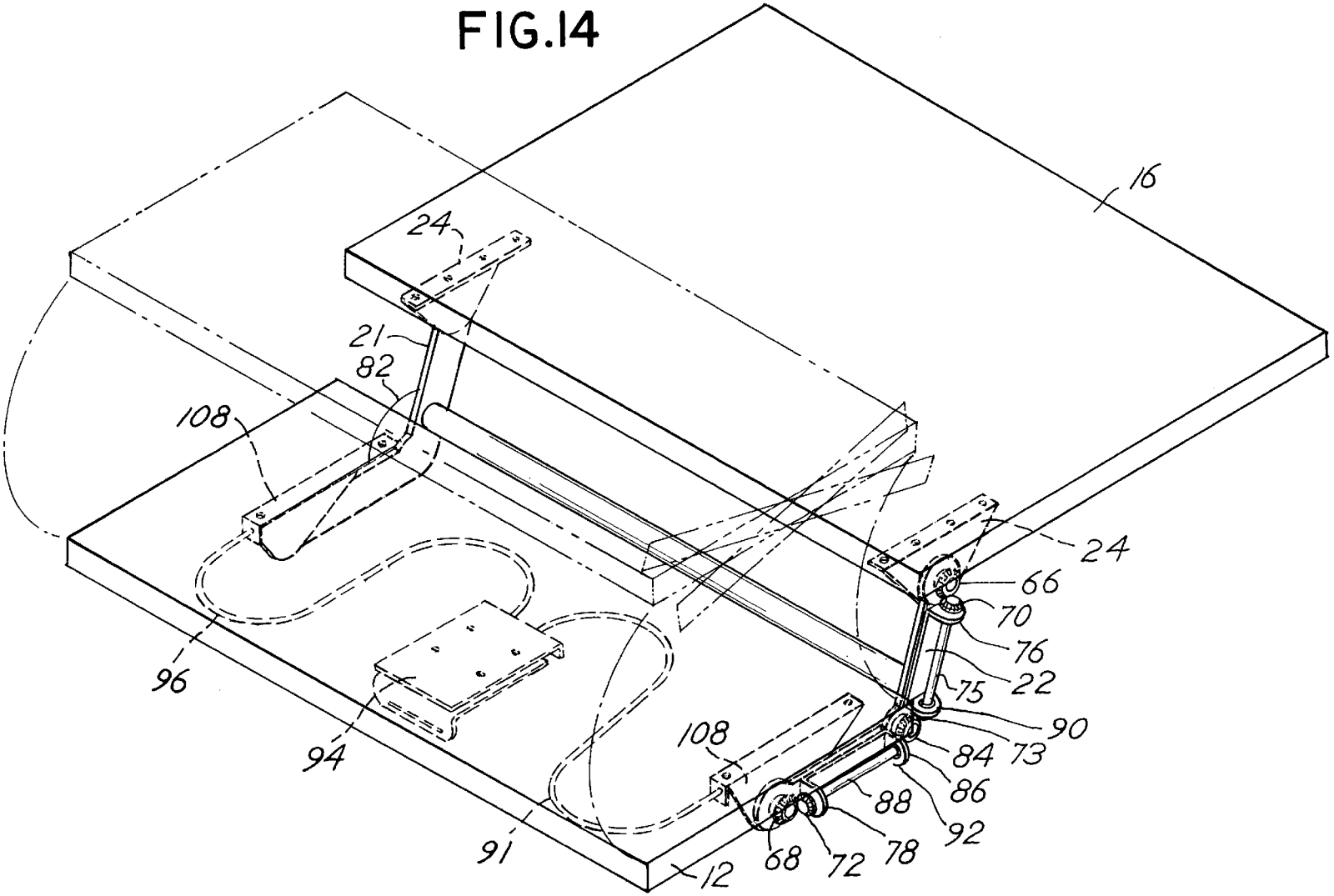
FIG. 14 is a perspective of the present invention with an alternative support arm configuration.
Figure 15:
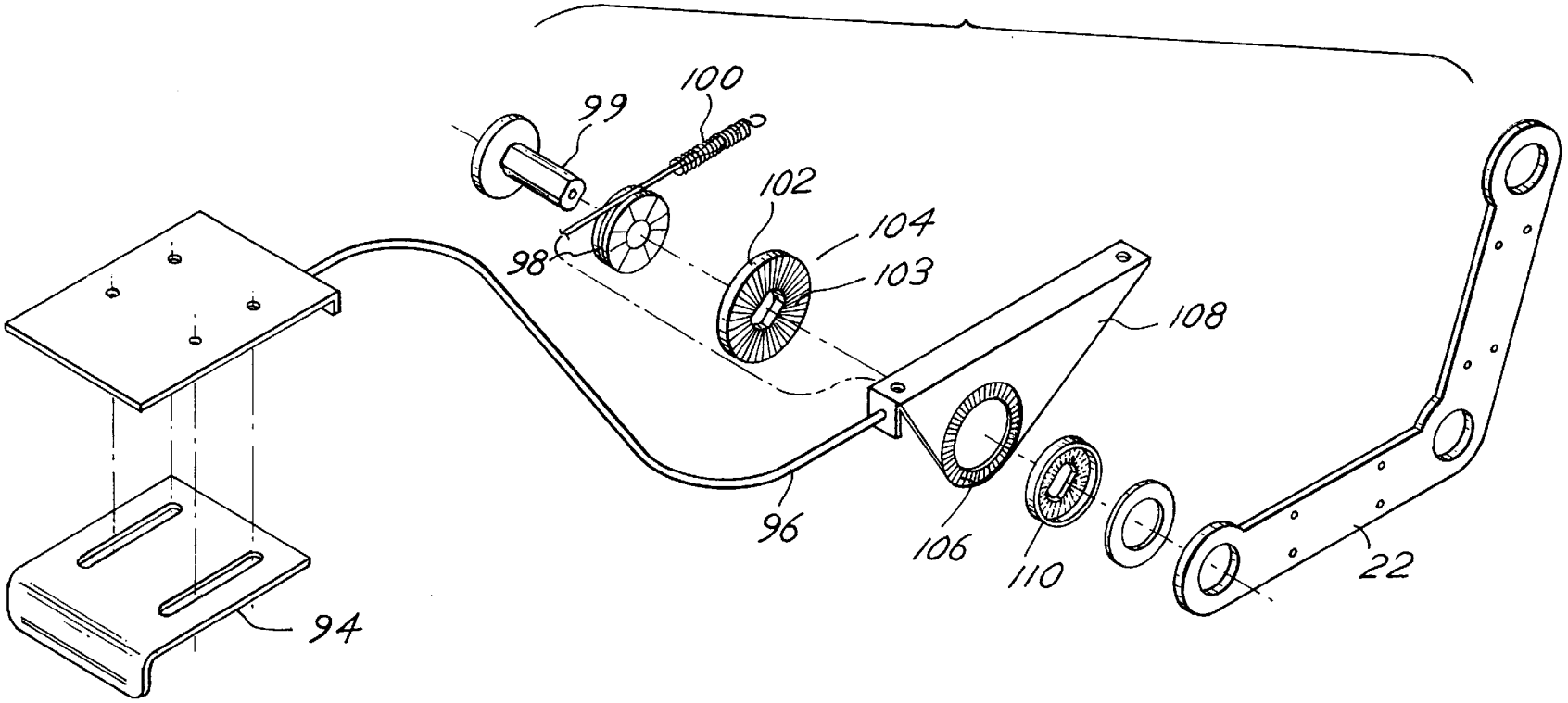
FIG. 15 is a detail of an alternative locking mechanism associated with the embodiment of FIG. 14.

An alternative preferred embodiment is illustrated in FIGS. 14 and 15. The operation of this embodiment is essentially the same as the prior embodiments of this invention. However, FIGS. 14 and 15 illustrate a different arm configuration. The support arms 21, 22 of FIG. 14 are configured to form an angle 82. The angle 82 may be any appropriate angle, however, in a preferred embodiment, the angle 82 is between 60° and 150° and more preferably between 85° and 110°. This configuration allows the computer keyboard platform 12 to be swung into a position above the surface of the work surface 16. This may provide an advantage in some working environments especially with respect to RSI.

Because of the different arm configuration, the compensating mechanism associated with the support arms 21, 22 has a slightly different structure. As with the other embodiments of the present invention, the compensating mechanism may be associated with either only one or both of the support arms 21, 22. It is preferred, however, that both support arms 21, 22 be associated with a compensating mechanism, thus such an embodiment is shown in FIG. 14 and described herein. Similar to the embodiment shown in FIGS. 12 and 13, in the embodiment of FIG. 14 a fixed beveled gear 66 is non-rotatably mounted on the mounting bracket 24. The fixed beveled gear 66 is associated with a first pinion shaft 75. The opposing end of first pinion shaft 75 engages a first intermediate pinion gear 73. The intermediate pinion gear 73 is associated with an intermediate rotating beveled gear 84. The intermediate rotating beveled gear 84 is also associated with a second intermediate pinion gear 86. The second intermediate pinion gear 86 is positioned at and engages one end of a second pinion shaft 88. The opposing end of the second pinion shaft 88 engages a second pinion gear 72. The second pinion gear is, in turn, associated with a rotating beveled gear 68.

The opposing ends of the first and second pinion shafts 75, 88 are associated with a first pinion shaft bearing 76, a second pinion shaft bearing 78, and intermediate pinion shaft bearings 90, 92 respectively. These pinion shaft bearings 76, 78, 90, 92 allow for rotation of the pinion shafts 75, 88 while the pinion gears 70, 72, 73, 86 are in operative engagement with the respective bevel gears 66, 68, 84. In addition, the pinion shaft bearings 76, 78, 90, 92 are affixed to the keyboard tray support arms 21, 22.

As stated earlier, it will be appreciated that other compensating means such as the sprocket and perforated tape mechanism of FIG. 1 or a planetary gear system could be substituted for the pinion shaft/gear mechanism without varying from the scope of the present invention.

FIGS. 14 and 15 also illustrate an alternative locking system for the present invention. As best illustrated in FIG. 15, the locking system is activated by a pull handle assembly 94. The pull handle assembly 94 is connected to one end of a cable 96. The other end of the cable 96 is connected to a rotating cam 98. When the pull handle assembly 94 is pulled, the cable 96 causes the rotating cam 98 to rotate about a horizontal axis defined by shaft 99. The rotating cam 98 is also operatively attached to a tension spring 100. The tension spring 100 acts to return the cam 98 to its original or home position once the pull handle assembly 94 is released.

The cam 98 engages a crammed engaging surface 102 of a first brake disc 104. The first brake disc 104 defines a braking surface 103 that is adapted to cooperate with a brake surface 106 on a keyboard platform mounting bracket 108 and a second brake disc 110. The second brake disc 110 defines a braking surface on each of its opposing sides. One such brake surface is adopted to engage the braking surface 103 of the first braking disc 104. The opposing braking surface is adopted to engage a braking surface defined by the support arm 22. Both first brake disc 104 and the second brake disc 110 are non-rotatably mounted on the shaft 99. The second beveled gear 68 is also non-rotatably mounted on the shaft 99. When the first brake disc 104, the braking surface 106 of the keyboard platform mounting bracket 108, the second brake disc 110 and the braking surface defined by the support arm 22 are engaged, the assembly is locked and the position of the keyboard platform 12 cannot be adjusted. when the rotating cam 98 is rotated such that the first brake disc 104, the brake surface 106 of the keyboard platform mounting bracket 108, and the second brake disc 110 are disengaged and the assembly can be adjusted between a storage position and a work position and the keyboard platform 12 can be tilted. Once adjusted, the assembly can be locked in place by releasing the pull handle assembly 94.

Figure 16:
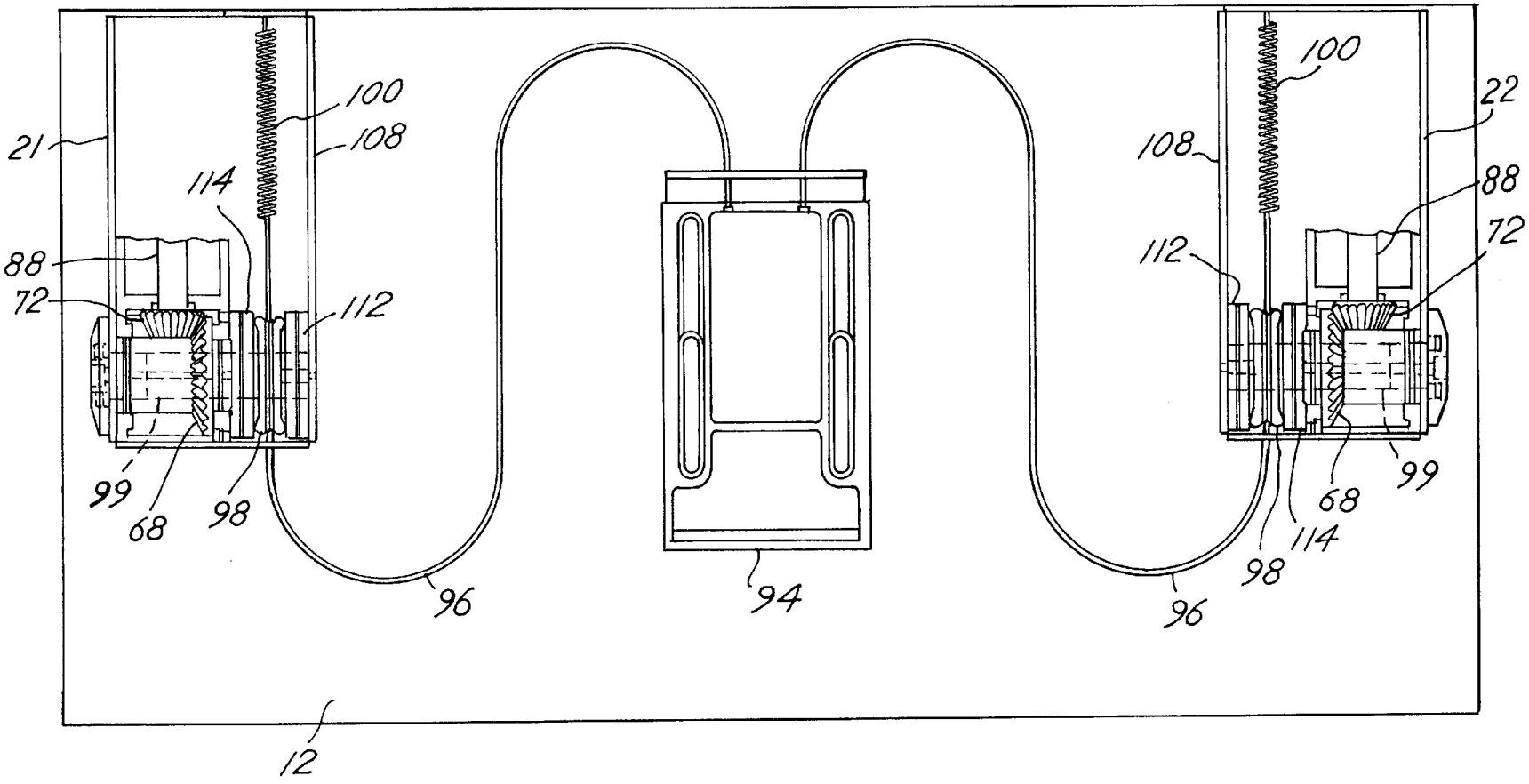
FIG. 16 is a detail of a second alternative locking mechanism for use in the present invention.

FIG. 16 illustrates an alternative embodiment of the locking system. In the alternative embodiment, the cam 98 has two cammed surfaces on its opposing faces and is positioned between the cooperates with the cammed surface 102 of two brake discs 112, 114. These discs 112, 114 cooperate with the brake surface 106 on the keyboard platform mounting bracket 108 and a brake surface 116 on the support arm 21, 22. The rotating cam 98 interacts with a pull handle assembly 94, in the same manner as described above. In this manner, the assembly can be locked and unlocked for adjustment.

In one embodiment of the present invention, it is also advantageous to supply the keyboard platform 12 with a keyboard clamp 14. The keyboard clamp 14 operates to secure the keyboard 10 to the keyboard platform 12. The keyboard clamp 14 is shown in FIG. 1. It is mounted on the keyboard platform 12 and acts upon the front and rear of the keyboard 110. The clamp 14 applies pressure to the keyboard 10, forcing it down onto the keyboard platform 12, thereby securing it to the keyboard platform 12 during adjustment or storage. In one embodiment of the present invention, the clamp 14 may be integral to the platform 12. Such an embodiment is illustrated in FIG. 1.

The present invention can also be supplied with power assist to aid in the adjustment of the device. Examples of such power assist would be a servo motor or an actuating cylinder that would act upon the support arms 21, 22 in a manner that would cause them to pivot about the first substantially horizontal axis 25. Such power assist provides the advantage of not requiring the operator to lift any weight and may provide the convenience of push button control.

It is possible to vary the construction of the invention by providing additional elements or eliminating other elements, without departing from the spirit and the scope of the invention. For example, as mentioned above, the assembly could include a slide mechanism 23 associated with the underside of the work surface 16, thereby allowing the entire assembly to be moved inwardly and outwardly with respect to the front edge 29 of the work surface 16. In addition, it is foreseeable that a vertical pivot could be associated with the keyboard platform 12, such that the computer keyboard platform 12 itself could pivot about a vertical axis passing through or near the platform 12. Such vertical pivot mechanisms are taught in the prior art and are well known to one skilled in the art. Thus, while there has been set forth here the preferred embodiment of the invention; it is understood that the invention is to be limited only by the following claims or their equivalents.

We claim:

1. An adjustable platform assembly for attachment of a generally horizontal platform to a generally horizontal work surface and providing means for transporting said platform between a work position and a storage position, while maintaining substantially the same orientation of the platform relative to the work surface, comprising in combination:

a first member for attachment to said work surface including a first substantially horizontal axis;

a second member for attachment to said platform and including a second substantially horizontal axis substantially parallel to the first horizontal axis;

a support arm pivotally connected at its opposite ends to the first member and the second member, said support arm forming an angle less than 180° whereby the support arm may transport the platform between the work position and the storage position by pivoting about said first substantially horizontal axis and where the platform is adjustable to a position above or below the level of the work surface; and a mechanical compensating mechanism mounted on the support arm for altering the orientation of the platform about the second axis with respect to the support arm when the second member and platform are rotated about the first substantially horizontal pivot axis between the work position and the storage position.

2. The adjustable platform assembly of claim 1 where in the compensating means comprises:

a first gear mechanism attached to the first member;

a second gear mechanism attached to the second member; and means for linking the first gear mechanism and the second gear mechanism, whereby when the second member is rotated about the first substantially horizontal axis, the means for linking causes the second gear mechanism to rotate the second member such that the orientation of the platform with respect to the horizontal is unchanged.

3. The adjustable platform assembly of claim 2 wherein:

the first gear mechanism comprises a first beveled gear attached to the first member and generally centered on the first substantially horizontal axis;

the second gear mechanism comprises a second beveled gear attached to the second member and generally centered on the second substantially horizontal axis; and the linking means comprises a first pinion shaft, a second pinion shaft, each pinion shaft having pinion gears at their opposing ends and an intermediate rotating beveled gear, wherein one end of the first pinion shaft engages the first beveled gear and the other end of the first pinion shaft engages the intermediate beveled gear and one end of the second pinion shaft engages the intermediate beveled gear and the other end of the second pinion draft engages the second beveled gear whereby when the platform is rotated about the first substantially horizontal axis, the first pinion shaft causes the intermediate beveled gear to rotate which in turn causes the second pinion shaft to rotate which causes the second beveled gear to rotate which keeps the orientation of the platform with respect to horizontal unchanged.

4. The adjustable platform assembly of claim 2 further comprising a means for locking the support arm to prevent pivotal movement about the first substantially horizontal pivot axis.

5. The adjustable platform support assembly of claim 4 wherein the means for locking pivotal movement comprises:

a pivot shaft disposed along the second horizontal axis and operatively associated with the second end of each support arm and fixed to the second gear mechanism of said compensating means, said pivot shaft comprising an inner shaft and two outer shafts each of which defines a cam bearing end, said outer shafts being concentrically surrounding the inner shaft and linearly opposed to each other with the cam bearing ends being located at adjacent ends of the outer shafts;

a locking cam adapted to engage the cam bearing ends of the outer shafts and the inner shaft to restrict the rotation of the pivot shaft about the second horizontal axis;

a locking lever adapted to move the locking cam to and from engagement and disengagement with the cam bearing surfaces of the outer shafts and the inner shaft.

6. The adjustable platform support assembly of claim 4 wherein the means for locking pivotal movement comprises:

a shaft disposed along the second substantially horizontal axis and non-rotatably associated with said second gear mechanism;

a cam rotatably mounted on said shaft, said cam defining at least one cammed surface;

means for rotating said cam on said shaft;

a first brake disc non-rotatably mounted on said shaft, said first brake disc defining a cam engaging side and a braking side said braking side defining a braking surface and said first brake disc being positioned to engage the cammed surface of said cam with said cam engaging side whereby when the cammed surface of the cam engages the cam engaging side of the first brake disc the first brake disc is forced away from the cam along the shaft; and a braking surface on the second end of said support arm whereby when the cam engages the cam engaging side of the first brake disc the braking surface of the first braking disc becomes securely associated with the braking surface on the support arm such that the platform is locked against rotation about the first substantially horizontal axis.

7. The adjustable platform support assembly of claim 6 further comprising a means for tilting the platform whereby the angle of the platform with respect to horizontal can be changed.

8. The adjustable platform support assembly of claim 7 wherein the second member defines a braking surface which becomes securely associated with the braking surface of the first braking disc when the cam engages the cam engaging side of the braking disc to form the tilting means.

9. The adjustable platform support assembly of claim 7 wherein said cam has two cammed surfaces, and the second member defines a braking surface, said tilt means comprising:

a second brake disc having a cam engaging side and a braking side said braking side defining a braking surface whereby when the second cammed surface of the cam engages the cam engaging side of the second brake disc the braking surface of the second braking disc becomes securely associated with the braking surface on the second member.

10. The adjustable platform support assembly of claim 6 wherein the cam rotating means comprises:

a cable defining a first end and a second end, said first end associated with said cam whereby pulling the cable causes the cam to rotate about the shaft;

a pull handle assembly associated with the second end of the cable whereby pulling the pull handle assembly pulls the cable and causes the cam to rotate about the shaft; and a tension spring associated with the cam and acting counter to the cable whereby the spring returns the cam to a home position when no force is exerted on the cable.

11. The adjustable platform support assembly of claim 10 wherein when the first cam is in the home position the platform is locked against rotation about the first substantially horizontal axis.

12. The adjustable platform support assembly of claim 2 further comprising a means for tilting platform whereby the angle of the platform with respect to horizontal can be changed.

13. The adjustable platform support assembly of claim 12 wherein the means for tilting further includes a tilt lock means for locking the platform at a selected angle.

14. The adjustable platform support assembly of claim 13 wherein the tilt lock means comprises a clutch surface on one outer shaft, a locking plate engaging the clutch surface and restricting the rotation of the platform with respect to said outer shaft and an actuator for engaging and disengaging the locking plate with the clutch surface.

15. The adjustable platform assembly of claim 14 wherein the locking lever is also the actuator.

* * * * *